US009976240B2

(12) United States Patent
Magara et al.

(10) Patent No.: US 9,976,240 B2
(45) Date of Patent: May 22, 2018

(54) EMBROIDERY FRAME

(71) Applicant: BROTHER KOGYO KABUSHIKI KAISHA, Nagoya-shi, Aichi-ken (JP)

(72) Inventors: Midori Magara, Nagoya (JP); Nobuhiko Funato, Gifu (JP)

(73) Assignee: BROTHER KOGYO KABUSHIKI KAISHA, Nagaya (JP)

( * ) Notice: Subject to any disclaimer, the term of this patent is extended or adjusted under 35 U.S.C. 154(b) by 449 days.

(21) Appl. No.: 14/618,638

(22) Filed: Feb. 10, 2015

(65) Prior Publication Data

US 2015/0240402 A1 Aug. 27, 2015

(30) Foreign Application Priority Data

Feb. 26, 2014 (JP) ..... 2014-034768

(51) Int. Cl.
*D05C 7/04* (2006.01)
*D05C 9/04* (2006.01)
*D05B 39/00* (2006.01)

(52) U.S. Cl.
CPC ..... *D05C 9/04* (2013.01); *D05B 39/00* (2013.01)

(58) Field of Classification Search
CPC ..... D05B 39/00; D05C 9/04
USPC ..... 112/103
See application file for complete search history.

(56) References Cited

U.S. PATENT DOCUMENTS 4,485,574 A * 12/1984 Bennetot ..... D05C 9/04 112/103
5,555,653 A * 9/1996 Morgan ..... D05C 1/04 38/102.2
6,901,870 B2 * 6/2005 Eklof ..... D05C 9/12 112/103
7,418,771 B2 * 9/2008 Hori ..... D05C 9/04 112/103
2004/0244661 A1 * 12/2004 Eklof ..... D05C 9/04 112/80.3

FOREIGN PATENT DOCUMENTS

JP H06-316854 A 11/1994

* cited by examiner

*Primary Examiner* — Nathan Durham
(74) *Attorney, Agent, or Firm* — Oliff PLC

(57) ABSTRACT

An embroidery frame includes an inner frame, an outer frame, an elastic member, and an attachment member. The inner frame is formed in a ring shape. The outer frame is formed in a ring shape and is configured to be fitted onto an outside of the inner frame. The elastic member is arranged on at least one of an outer peripheral surface of the inner frame and an inner peripheral surface of the outer frame. The attachment member detachably attaches the elastic member to one of the inner frame and the outer frame.

16 Claims, 13 Drawing Sheets

FIG. 9

| SEWING WORKPIECE (FABRIC) | | TYPE OF ELASTIC BODY | MATERIAL | HARDNESS | SURFACE PROFILE |
|---|---|---|---|---|---|
| THIN FABRIC | BROADCLOTH | 80A | HERMOPLASTIC ELASTOMER | 70° | TYPE 1 |
| | ORGANDIE | 80B | URETHANE RUBBER | 60° | TYPE 2 |
| NORMAL FABRIC | FELT | 80C | SILICONE RUBBER | 60° ~ 80° | TYPE 3 |
| | COTTON SAILCLOTH | | | | |
| THICK FABRIC | DENIM | 80D | THERMOPLASTIC ELASTOMER | 80° | TYPE 4 |
| | LEATHER | 80E | URETHANE RUBBER | 70° | TYPE 2 |

EMBROIDERY FRAME

CROSS-REFERENCE TO RELATED APPLICATION

This application claims priority to Japanese Patent Application No. 2014-34768, filed Feb. 26, 2014. The disclosure of the foregoing application is incorporated herein by reference in its entirety.

BACKGROUND

The present disclosure relates to an embroidery frame that includes an outer frame and an inner frame.

An embroidery frame to which a work cloth has been attached is mounted on a frame driving mechanism of an embroidery sewing machine. The embroidery sewing machine drives the frame driving mechanism and causes the embroidery frame to move individually in an X direction (a left-right direction) and a Y direction (a front-rear direction). The embroidery sewing machine forms a desired embroidery pattern on the work cloth. The embroidery frame includes a substantially rectangular inner frame, a substantially rectangular outer frame and a fastening mechanism. The fastening mechanism fastens the outer frame to the inner frame. For example, a known embroidery frame includes an elastic body around the entire periphery of the inner frame. The elastic body has a contact portion that protrudes toward the outer frame. The contact portion comes into contact with the work cloth. A frictional resistance increases due to the contact portion coming into contact with the work cloth. Thus, a force with which the embroidery frame holds the work cloth is improved.

SUMMARY

There are various types of work cloth material, and even when the same material is used, each work cloth may have a different cloth thickness. Therefore, when the elastic body is not suitable for the type and the cloth thickness of the work cloth, the elastic body may not operate effectively.

Various embodiments of the broad principles derived herein provide an embroidery frame that may improve a holding force with which a sewing workpiece is held, regardless of a type and a cloth thickness of the sewing workpiece.

The exemplary embodiments described herein provide an embroidery frame that includes an inner frame, an outer frame, an elastic member, and an attachment member. The inner frame is formed in a ring shape. The outer frame is formed in a ring shape and is configured to be fitted onto an outside of the inner frame. The elastic member is arranged on at least one of an outer peripheral surface of the inner frame and an inner peripheral surface of the outer frame. The attachment member detachably attaches the elastic member to one of the inner frame and the outer frame.

BRIEF DESCRIPTION OF THE DRAWINGS

Embodiments of the present disclosure will be described below in detail with reference to the accompanying drawings in which:

FIG. 9 is a table showing types of the sewing workpiece and types of the elastic body;

DETAILED DESCRIPTION

Figure 1:
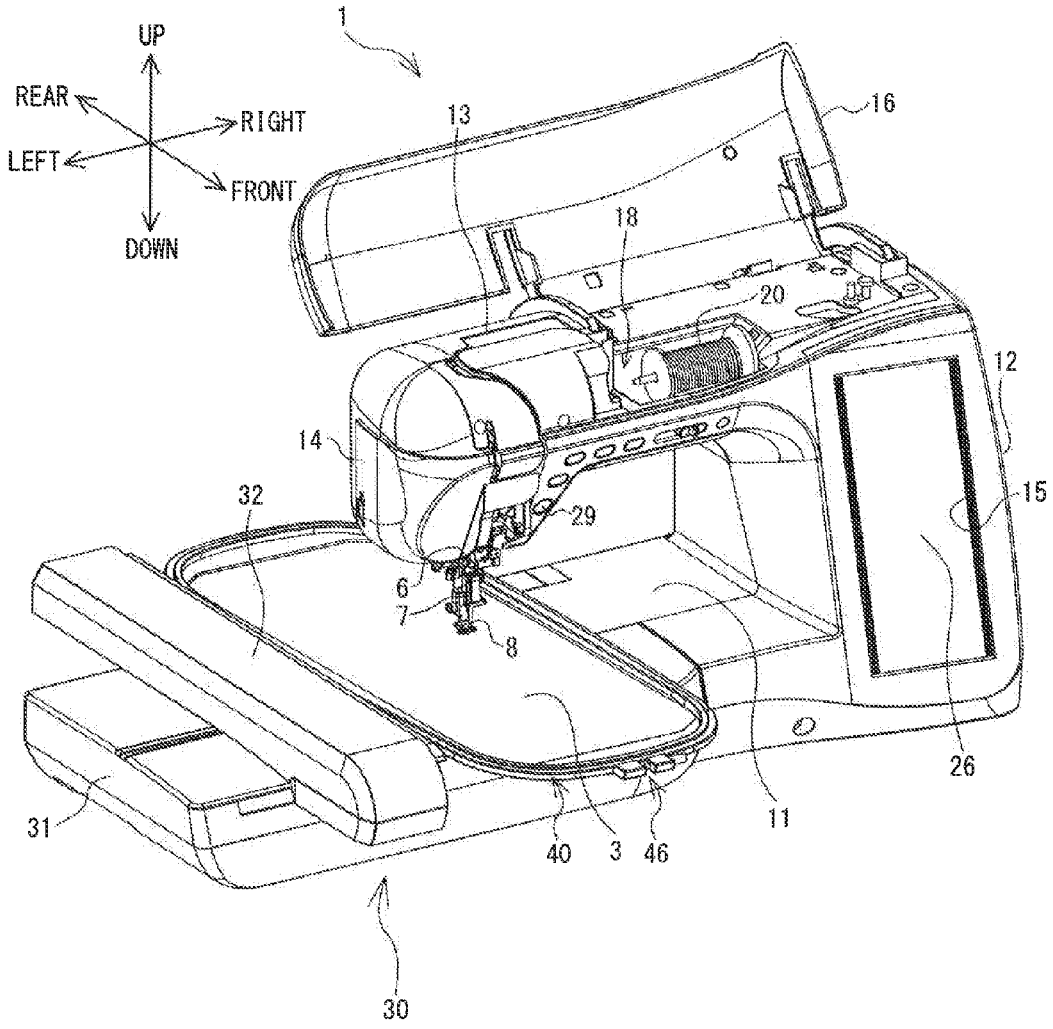
FIG. 1 is a perspective view of a sewing machine.

An embodiment of the present disclosure will be explained with reference to the drawings. A physical configuration of a sewing machine 1 will be explained with reference to FIG. 1. In the explanation below, the upper side, the lower side, the lower right side, the upper left side, the lower left side and the upper right side of FIG. 1 are respectively defined as the upper side, the lower side, the front side, the rear side, the left side and the right side of the sewing machine 1. A surface on which a liquid crystal display 15 is disposed is a front surface of the sewing machine 1. The extending direction of a bed portion 11 and an arm portion 13 is the left-right direction of the sewing machine 1. The side on which a pillar 12 is disposed is the right side of the sewing machine 1. The extending direction of the pillar 12 is the up-down direction of the sewing machine 1. The sewing machine 1 is provided with the bed portion 11, the pillar 12, the arm portion 13 and a head portion 14. The bed portion 11 is a base portion of the sewing machine 1 and extends in the left-right direction. The pillar 12 extends upward from a right end portion of the bed portion 11. The arm portion 13 extends to the left from the upper end of the pillar 12 such that the arm portion 13 faces the bed portion 11. The head portion 14 is connected to a left end portion of the arm portion 13. A needle plate is provided on an upper surface of the bed portion 11, and the needle plate has a needle hole. The sewing machine 1 is provided with a feed dog, a feed mechanism, a shuttle mechanism and the like below the needle plate (namely, inside the bed portion 11). The feed mechanism drives the feed dog when normal sewing is performed. The normal sewing is sewing that is different from embroidery sewing. The feed dog moves a sewing workpiece (for example, a work cloth, a synthetic resin sheet or the like). The shuttle mechanism entwines an upper thread with a lower thread below the needle plate. The respective elements and the respective mechanisms described above are known and illustrations of them are omitted.

The sewing machine 1 is provided with a transport mechanism 30 of an embroidery frame. The transport mechanism 30 is configured to be mounted on and removed from the bed portion 11. FIG. 1 shows a state in which the transport mechanism 30 is mounted on the sewing machine 1. The transport mechanism 30 mounted on the bed portion 11 is electrically connected to the sewing machine 1. The transport mechanism 30 is provided with a main body portion 31 and a movable portion 32. The movable portion 32 is provided on the upper side of the main body portion 31. The movable portion 32 has a cuboid shape that is long in the front-rear direction, and is provided with a carriage (not shown in the drawings), a Y axis transport mechanism (not shown in the drawings) and a Y axis motor (not shown in the drawings). The carriage is provided on a right side surface of the movable portion 32. A selected one of a plurality of types of embroidery frames is configured to be mounted on and removed from the carriage. An embroidery frame 40 clamps and holds a sewing workpiece 3 using an outer frame 50 and an inner frame 60. When the embroidery frame 40 is mounted on the carriage (refer to FIG. 1), the sewing workpiece 3 held by the embroidery frame 40 is on the upper side of the needle plate and below a needle bar 6 and a presser foot 8. The Y axis motor drives the Y axis transport mechanism. The Y axis transport mechanism moves the carriage in the front-rear direction (the Y axis direction). The carriage moves the embroidery frame 40 in the front-rear direction. Thus, the sewing workpiece 3 held by the embroidery frame 40 is moved in the front-rear direction.

The main body portion 31 is internally provided with an X axis transport mechanism (not shown in the drawings) and an X axis motor (not shown in the drawings). The X axis motor drives the X axis transport mechanism. The X axis transport mechanism moves the movable portion 32 in the left-right direction (the X axis direction). The movable portion 32 moves the embroidery frame 40 in the left-right direction. Thus, the sewing workpiece 3 held by the embroidery frame 40 is moved in the left-right direction. Therefore, the transport mechanism 30 can move the embroidery frame 40 in the front-rear direction and in the left-right direction.

The liquid crystal display 15 is provided on the front surface of the pillar 12. The liquid crystal display 15 displays an image including a variety of items. The variety of items are, for example, commands, illustrations, setting values, messages and the like. A touch panel 26 is provided on the front side of the liquid crystal display 15. The touch panel 26 is configured to detect a pressed position. For example, a user uses a finger or a stylus pen to perform an operation that presses the touch panel 26. The touch panel 26 detects a position pressed by the finger or the stylus pen. Based on the detected position, a CPU (not shown in the drawings) of the sewing machine 1 recognizes the item selected on the image. The operation that presses the touch panel 26 is referred to as a panel operation. Through the panel operation, the user can select a pattern to be sewn or a command to be executed. The pillar 12 is internally provided with a sewing machine motor (not shown in the drawings).

A cover 16 that is configured to open and close is provided on an upper portion of the arm portion 13. In FIG. 1, the cover 16 is in an open state. A thread housing portion 18 is provided below the cover 16 (namely, inside the arm portion 13). The thread housing portion 18 is configured to house a thread spool 20 around which the upper thread is wound. A drive shaft (not shown in the drawings) that extends in the left-right direction is provided inside the arm portion 13. The sewing machine motor rotates the drive shaft. Various switches including a start/stop switch 29 are provided on a lower left portion of a front surface of the arm portion 13. The start/stop switch 29 is used to input a command to start or stop sewing. The command to start sewing is a command to start the operation of the sewing machine 1. The command to stop sewing is a command to stop the operation of the sewing machine 1.

Figure 2:
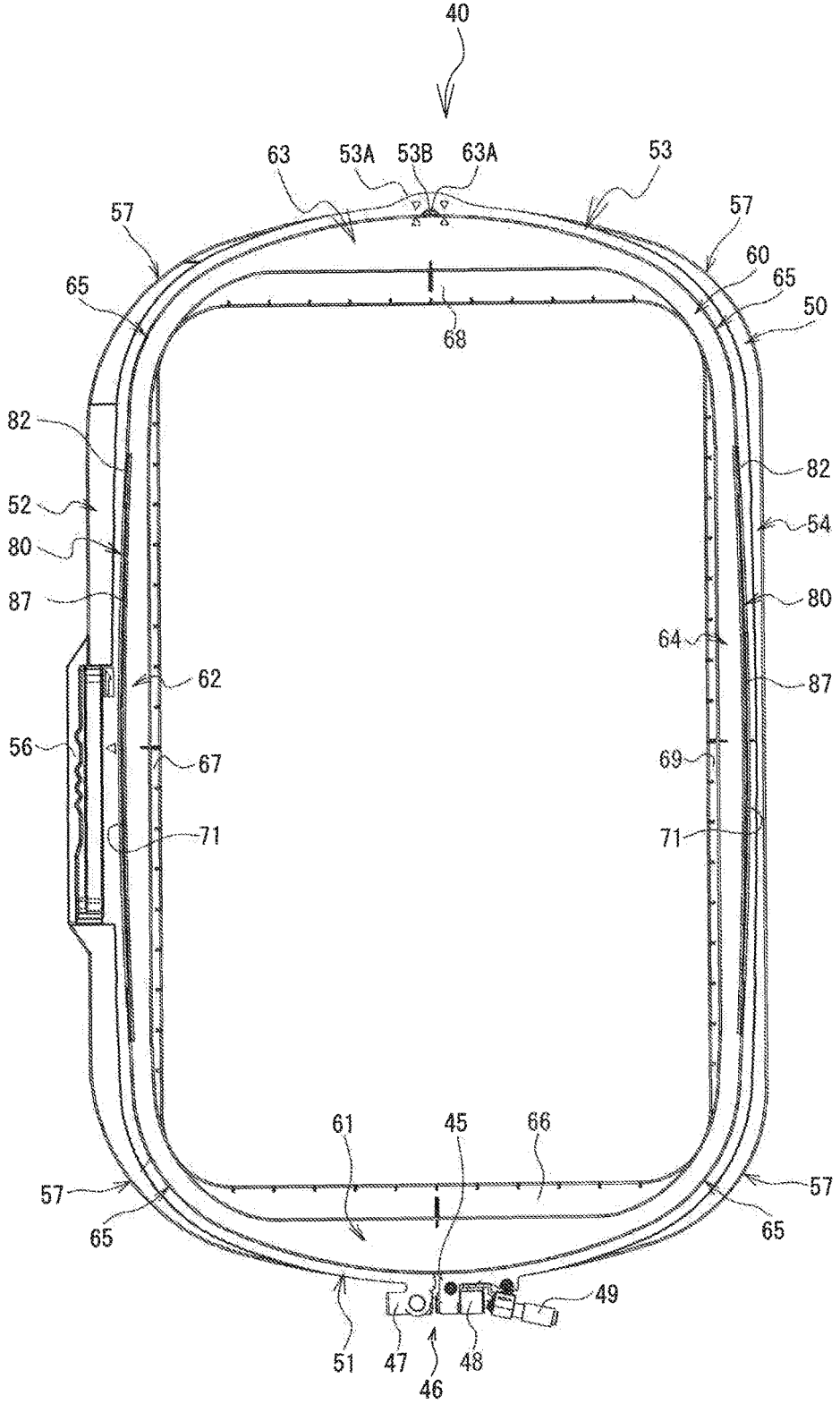
FIG. 2 is a plan view of an embroidery frame.

A structure of the embroidery frame 40 will be explained with reference to FIG. 2. As shown in FIG. 2, the embroidery frame 40 has a substantially rectangular ring shape. The embroidery frame 40 is provided with the outer frame 50 and the inner frame 60. The outer frame 50 is a substantially rectangular ring-shaped frame body. The inner frame 60 is a substantially rectangular ring-shaped frame body that fits into the inside of the outer frame 50. Although the outer frame 50 and the inner frame 60 are made of synthetic resin, they may be made of metal or materials that are different from each other.

Figure 3:
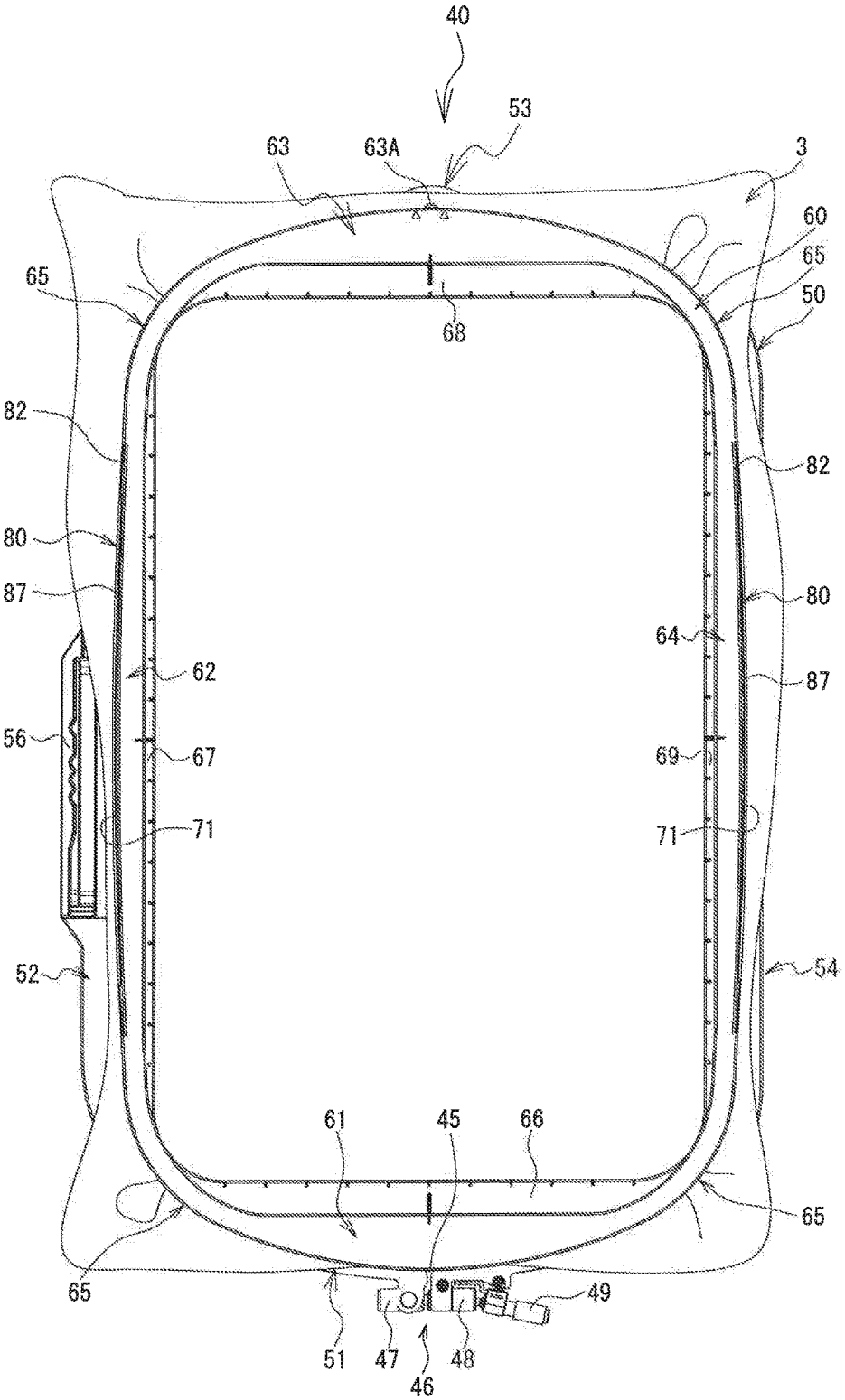
FIG. 3 is a plan view of the embroidery frame in a state in which a sewing workpiece is clamped and held.

A structure of the outer frame 50 will be explained with reference to FIG. 2 and FIG. 3. As shown in FIG. 2, the outer frame 50 is provided with outer frame sides 51 to 54, four corner portions 57 and the like. The outer frame sides 51 and 53 are a pair of short side portions. The outer frame sides 51 and 53 each bulge in an arc shape toward the outside. The outer frame sides 52 and 54 are a pair of long side portions that are longer than the outer frame sides 51 and 53. The outer frame sides 52 and 54 extend substantially linearly in a direction that is substantially orthogonal to the extending direction of the outer frame sides 51 and 53. The four corner portions 57 are formed substantially in an arc shape in a plan view such that they respectively connect the outer frame sides 51 and 52, the outer frame sides 52 and 53, the outer frame sides 53 and 54, and the outer frame sides 54 and 51. A frame attachment portion 56 is provided on an outer peripheral surface at the center in the extending direction of the outer frame side 52. The frame attachment portion 56 is a portion that is attached to the carriage. A divided portion 45 is provided at a center portion in the extending direction of the outer frame side 51. The divided portion 45 has a gap that is formed by dividing the outer frame side 51. A fastening mechanism 46 is provided on the divided portion 45. The fastening mechanism 46 is a known mechanism that is configured to fasten the outer frame 50 to the inner frame 60, and is provided with screw mounting portions 47 and 48, an adjustment screw (not shown in the drawings), an operation shaft 49 and the like. The screw mounting portions 47 and 48 are provided on both sides of the divided portion 45 such that the gap of the divided portion 45 is located between them. The adjustment screw is provided on the screw mounting portions 47 and 48 such that the adjustment screw can rotate. When the adjustment screw rotates in one direction, an interval between the screw mounting portions 47 and 48 is reduced. When the adjustment screw rotates in another direction (an opposite direction to the one direction), the interval between the screw mounting portions 47 and 48 is increased. The operation shaft 49 is connected to the adjustment screw. When the user rotates the operation shaft 49, the adjustment screw rotates. As shown in FIG. 3, in a state in which the outer frame 50 and the inner frame 60 clamp the sewing workpiece 3, the user rotates the operation shaft 49 in the one direction. The adjustment screw rotates in the one direction in accordance with the rotation of the operation shaft 49 in one direction, the interval between the screw mounting portions 47 and 48 is reduced, and the outer frame 50 may be fastened to the inner frame 60. A positioning portion 53A is provided at a center portion in the extending direction of the outer frame side 53. The positioning portion 53A protrudes in an arc shape toward the outside. A recessed portion 53B is provided on the inside of the positioning portion 53A. The recessed portion 53B is an arc-shaped recess that faces the inside of the inner frame 60. A protruding portion 63A of the inner frame 60 fits into the recessed portion 53B when the inner frame 60 is fitted into the outer frame 50.

Figure 4:
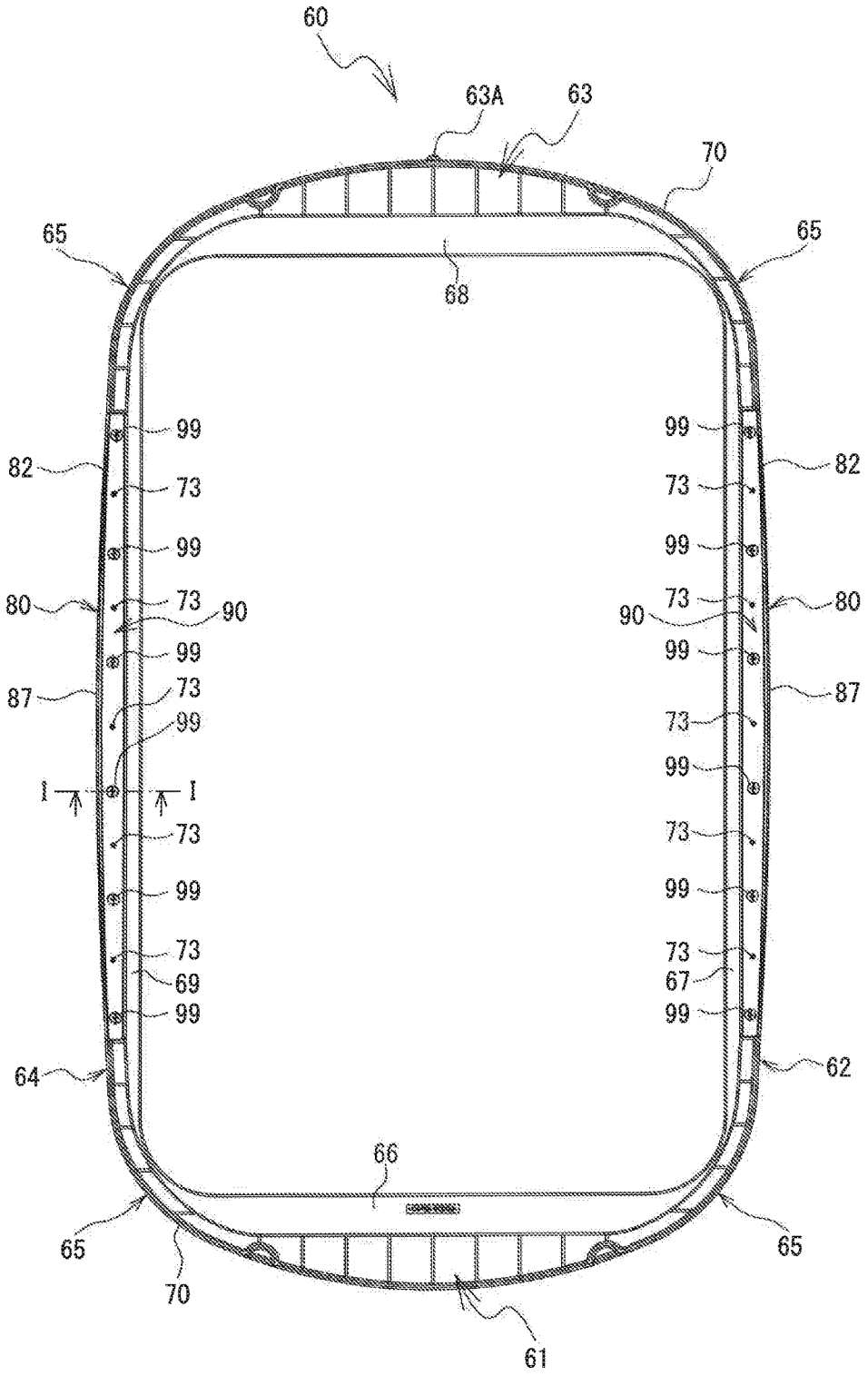
FIG. 4 is a bottom view of an inner frame.
Figure 5:
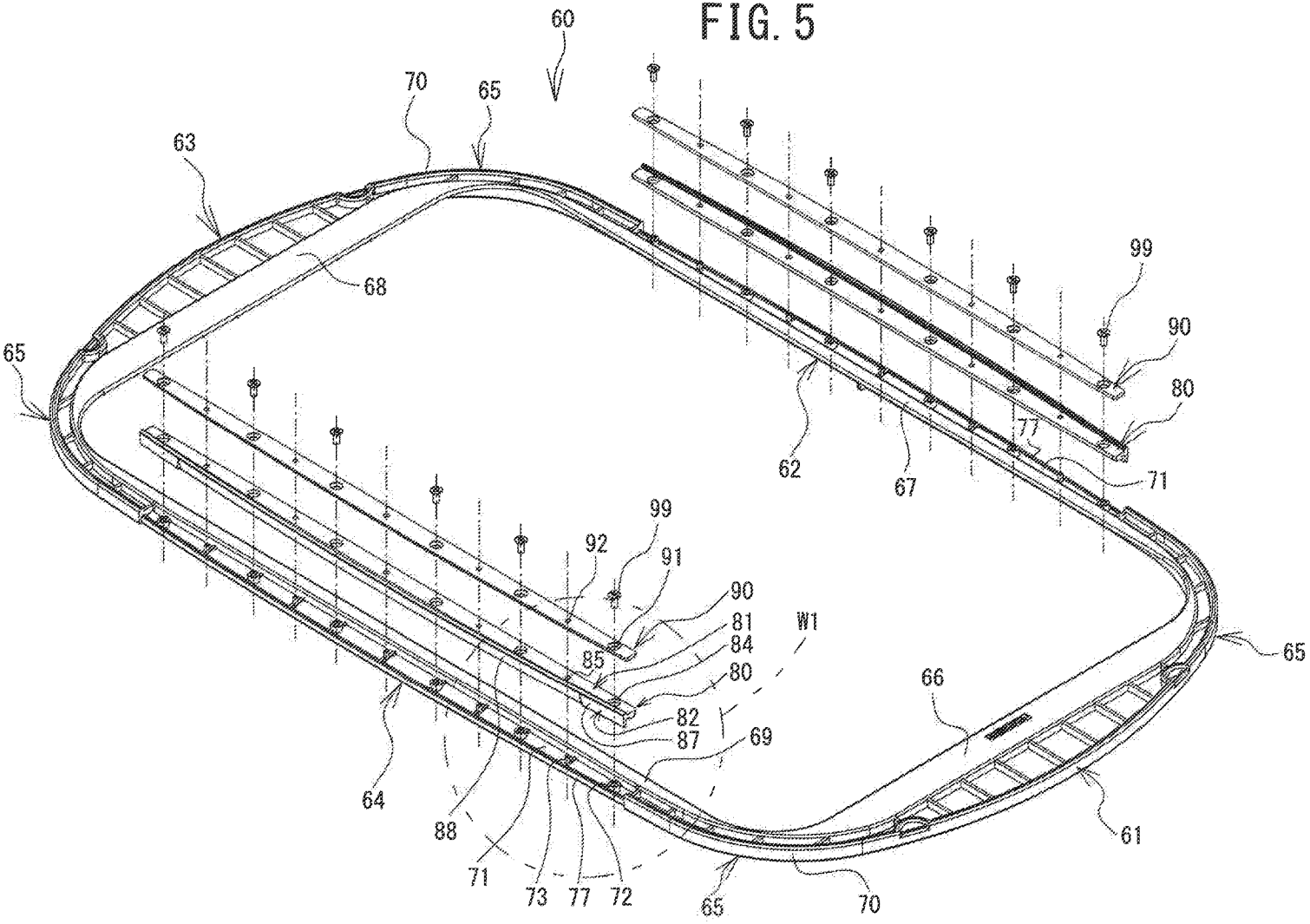
FIG. 5 is an exploded perspective view of a state in which the bottom surface side of the inner frame is directed upward.

The structure of the inner frame 60 will be explained with reference to FIG. 4 to FIG. 8. FIG. 4 and FIG. 5 show a state in which the bottom surface side of the inner frame 60 is directed upward. As shown in FIG. 4, the inner frame 60 is provided with inner frame sides 61 to 64, four corner portions 65, two elastic bodies 80, two presser plates 90 and twelve screws 99. The inner frame sides 61 and 63 are a pair of short side portions. Outer side surfaces of the respective inner frame sides 61 and 63 bulge in an arc shape toward the outside. The inner frame sides 62 and 64 are a pair of long side portions that are longer than the inner frame sides 61 and 63. The inner frame sides 62 and 64 extend substantially linearly in a direction that is substantially orthogonal to the extending direction of the inner frame sides 61 and 63. The four corner portions 65 are formed substantially in an arc shape in a plan view such that they respectively connect the inner frame sides 61 and 62, the inner frame sides 62 and 63, the inner frame sides 63 and 64, and the inner frame sides 64 and 61. The two elastic bodies 80 are respectively arranged on the inner frame sides 62 and 64. The two elastic bodies 80 are configured to be attached and removed using the presser plates 90 and the screws 99. As shown in FIG. 4 and FIG. 5, reinforcement ribs 66 to 69 are provided on a lower portion of the inner peripheral edge of the inner frame 60. Each of the reinforcement ribs 66 to 69 extends horizontally on the inside of the inner frame 60. The reinforcement rib 66 is provided on a lower portion of an inner side surface of the inner frame side 61. The reinforcement rib 67 is provided on a lower portion of an inner side surface of the inner frame side 62. The reinforcement rib 68 is provided on a lower portion of an inner side surface of the inner frame side 63. The reinforcement rib 69 is provided on a lower portion of an inner side surface of the inner frame side 64. An extending width of the reinforcement ribs 66 and 68 is slightly longer than an extending width of the reinforcement ribs 67 and 69. A first edge rib 70 extends along the outer periphery of a lower surface of each of the inner frame sides 61 to 64, and protrudes downward. The reinforcement ribs 66 to 69 and the first edge rib 70 reinforce the strength of the inner frame sides 61 to 64. Therefore, when the inner frame 60 and the outer frame 50 clamp the sewing workpiece 3, a favorable stretched state of the sewing workpiece 3 is obtained. Some or all of the reinforcement ribs 66 to 69 and the first edge rib 70 may be omitted. As shown in FIG. 4, the protruding portion 63A is provided at a center portion in the extending direction of an outer peripheral surface of the inner frame side 63. The protruding portion 63A protrudes in an arc shape toward the outside. When the user fits the inner frame 60 into the outer frame 50, the user fits the protruding portion 63A into the recessed portion 53B shown in FIG. 2. Therefore, the user may easily position the inner frame 60 with respect to the outer frame 50. As shown in FIG. 5, one of attachment surfaces 71 is provided at a center portion in the extending direction of the lower surface (a surface on the upper side in FIG. 5) of the inner frame side 62. The center portion in the extending direction of the lower surface of the inner frame side 62 is a part of the lower surface of the inner frame side 62 excluding both end sides in the extending direction of the lower surface. In a similar manner, the other attachment surface 71 is provided at a center portion in the extending direction of the lower surface (a surface on the upper side in FIG. 5) of the inner frame side 64. The center portion in the extending direction of the lower surface of the inner frame side 64 is a part of the lower surface of the inner frame side 64 excluding both end sides in the extending direction of the lower surface. The attachment surface 71 of the inner frame side 62 and the attachment surface 71 of the inner frame side 64 each divide the first edge rib 70. The attachment surfaces 71 are portions to which the elastic bodies 80 are respectively attached. One of second edge ribs 77 extends along the outer edge of the attachment surface 71 of the inner frame side 62, and protrudes downward. In a similar manner, the other second edge rib 77 extends along the outer edge of the attachment surface 71 of the inner frame side 64, and protrudes downward. Both the second edge rib 77 of the inner frame side 62 and the second edge rib 77 of the inner frame side 64 have a protruding length that is shorter than that of the first edge rib 70. The attachment surface 71 of the inner frame side 62 and the attachment surface 71 of the inner frame side 64 are symmetrically formed. Therefore, the attachment surface 71 of the inner frame side 64 will be explained and an explanation of the attachment surface 71 of the inner frame side 62 will be omitted.

Figure 6:
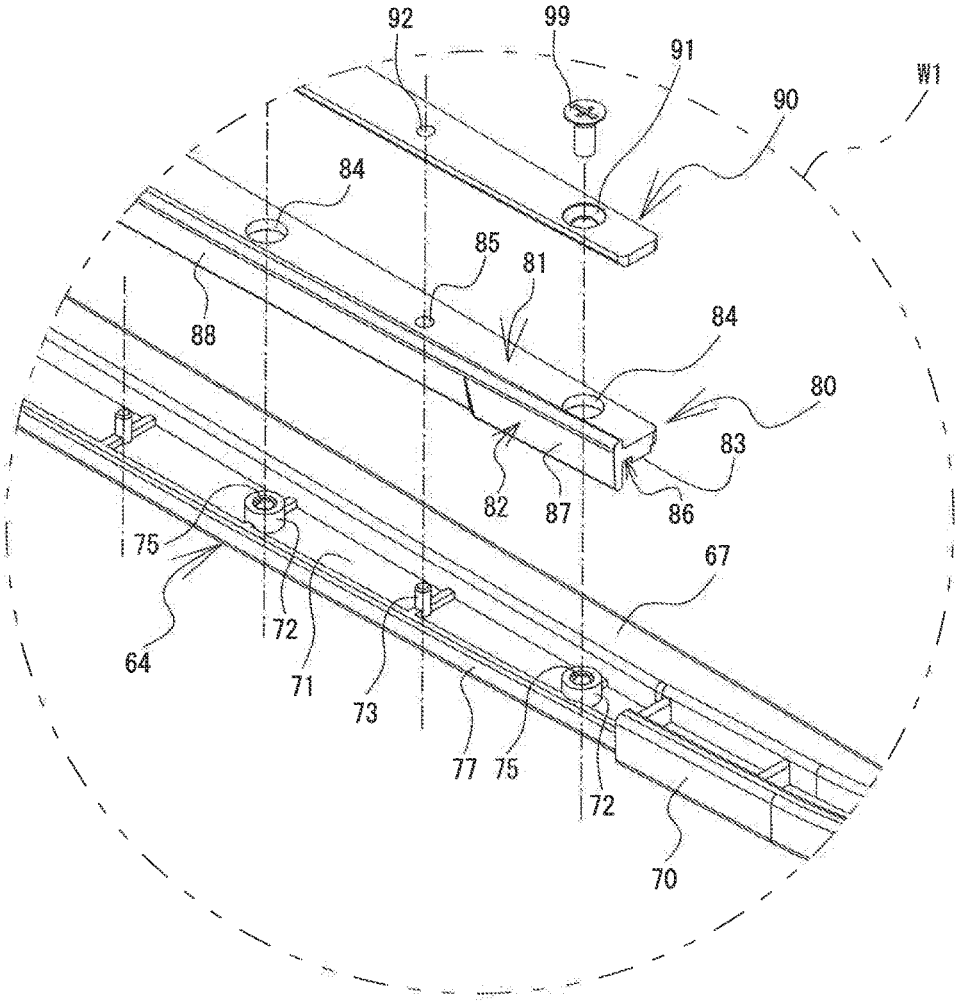
FIG. 6 is an enlarged view of an area W1 shown in FIG. 5.

As shown in FIG. 5 and FIG. 6, the attachment surface 71 is strip shaped in a bottom view. The width of the attachment surface 71 gradually increases from both end sides in the extending direction of the attachment surface 71 toward the center. Six bosses 72 and five pins 73 are alternately provided along the extending direction of the attachment surface 71. Two of the six bosses 72 are provided on both the end sides in the extending direction of the attachment surface 71. As shown in FIG. 6, each of the bosses 72 vertically protrudes from the attachment surface 71. A screw hole 75 is provided inside each of the bosses 72. Each of the pins 73 vertically protrudes from the attachment surface 71. The protruding length of each of the pins 73 is longer than the protruding length of each of the bosses 72. It is preferable that the protruding length of each of the pins 73 is longer than the thickness of a receiving portion 81. The outer diameter of each of the pins 73 is smaller than the outer diameter of each of the bosses 72.

The shape of the elastic body 80 will be explained with reference to FIG. 5 to FIG. 7. The elastic body 80 is a long member. A cross section that is orthogonal to the extending direction of the elastic body 80 is substantially T-shaped. As long as the material of the elastic body 80 is an elastic material, it may be, for example, a thermoplastic elastomer, urethane rubber, silicone rubber or the like. The length in the extending direction of the elastic body 80 is substantially the same as the length in the extending direction of the attachment surface 71. As shown in FIG. 6, the elastic body 80 is provided with the receiving portion 81 and a contact portion 82. The receiving portion 81 is a portion that is attached to the attachment surface 71. The receiving portion 81 extends horizontally and has a plate shape that is substantially the same shape as the attachment surface 71. Six insertion holes 84 and five small holes 85 are alternately provided along the extending direction of the receiving portion 81. Each of the insertion holes 84 and each of the small holes 85 penetrate the receiving portion 81 in a thickness direction. Two of the six insertion holes 84 are provided on both end sides in the extending direction of the receiving portion 81. Positions of the six insertion holes 84 and the five small holes 85 respectively correspond to positions of the six bosses 72 and the five pins 73 that are provided on the attachment surface 71. The inner diameter of each of the insertion holes 84 is substantially the same as the outer diameter of each of the bosses 72. The inner diameter of each of the small holes 85 is substantially the same as the outer diameter of each of the pins 73.

Figure 7:
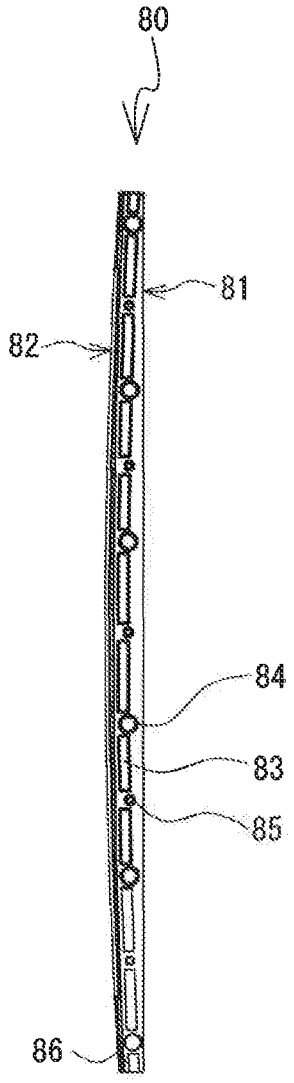
FIG. 7 is a rear view of an elastic body.

As shown in FIG. 7, twelve rectangular ribs 83 are provided on the receiving portion 81. Two of the twelve rectangular ribs 83 are provided on both the end sides in the extending direction of the receiving portion 81. Ten of the twelve rectangular ribs 83 are each positioned between the insertion hole 84 and the small hole 85 that are adjacent to each other. Each of the rectangular ribs 83 is a rectangular convex portion, and an upper surface of each of the rectangular ribs 83 comes into contact with the attachment surface 71 of the inner frame 60. A locking groove 86 (refer to FIG. 6) is a recessed portion that is positioned between the twelve rectangular ribs 83 and the contact portion 82.

As shown in FIG. 6, the contact portion 82 is a portion that comes into contact with the sewing workpiece 3 that is clamped by the outer frame 50 and the inner frame 60. The contact portion 82 has a substantially rectangular plate shape and is orthogonal to the receiving portion 81. The contact portion 82 has a contact surface 87 and an inclined surface 88. The contact surface 87 is a surface of the contact portion 82 that is on the opposite side to a surface of the contact portion 82 that is connected to the receiving portion 81. The contact surface 87 is a surface that directly comes into contact with the sewing workpiece 3. The inclined surface 88 is a part of the contact portion 82 excluding both the edges in the extending direction of the contact surface 87. In a state in which the elastic body 80 is attached to the attachment surface 71, the inclined surface 88 is inclined in a direction to approach the inside of the inner frame 60, from the lower surface side toward the upper surface side (in the direction from the upper side toward the lower side in FIG. 8) of the inner frame 60. The surface profile of the contact surface 87 differs depending on the type of the elastic body 80.

Figure 8:
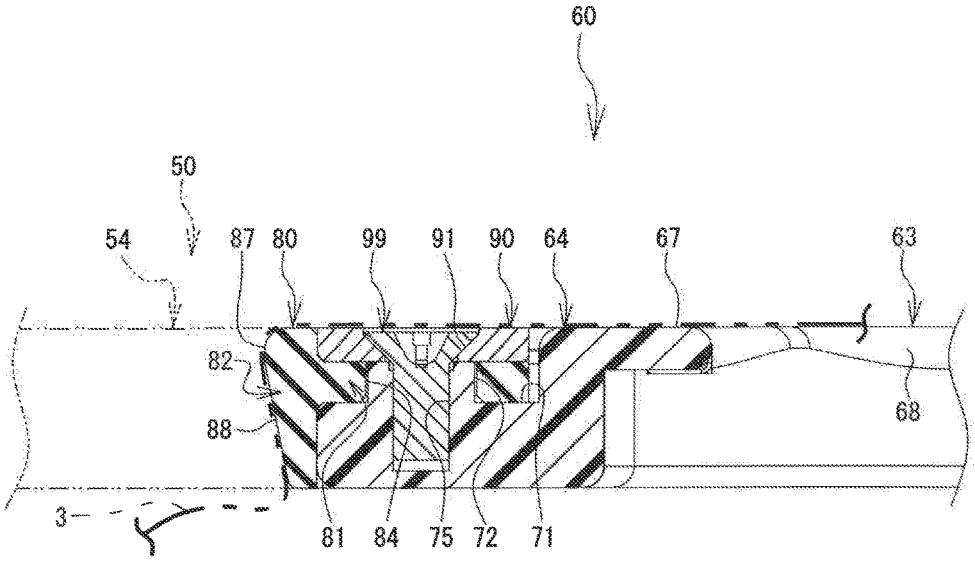
FIG. 8 is a cross-sectional view taken in the direction of arrows along a line I-I shown in FIG. 4.

The shape of the presser plate 90 will be explained with reference to FIG. 5 and FIG. 6. The presser plate 90 is a member that pushes the elastic body 80 against the attachment surface 71. The presser plate 90 has a plate shape that is substantially the same shape as the receiving portion 81. Although the presser plate 90 is made of aluminum, it may be made of another metal or synthetic resin. It is preferable that the material of the presser plate 90 is a lightweight and high strength material. Six attachment holes 91 and five small holes 92 are alternately provided along the extending direction of the presser plate 90. Each of the attachment holes 91 and each of the small holes 92 penetrate the presser plate 90 in a thickness direction. Two of the six attachment holes 91 are provided on both end sides in the extending direction of the presser plate 90. An inlet of each of the attachment holes 91 is chamfered, as shown in FIG. 6 and FIG. 8.

A method for attaching the elastic bodies 80 to the inner frame 60 will be explained with reference to FIG. 4 to FIG. 8. As an example, a method for attaching the elastic body 80 to the attachment surface 71 of the inner frame side 64 will be explained. As shown in FIG. 5, the user places the inner frame 60 on a table (not shown in the drawings) in a state in which the bottom surface of the inner frame 60 is directed upward. Then, in a state in which the contact portion 82 faces to the outside of the inner frame side 64, the user arranges the receiving portion 81 on the attachment surface 71 such that lower surfaces (refer to FIG. 7) of the rectangular ribs 83 come into contact with the attachment surface 71. As shown in FIG. 6, the user locks the second edge rib 77 into the locking groove 86.

As shown in FIG. 5 and FIG. 6, the user inserts each of the bosses 72 into each of the six insertion holes 84. Further, the user inserts each of the pins 73 into each of the five small holes 85. The inner diameter of each of the insertion holes 84 is substantially the same as the outer diameter of each of the bosses 72. Therefore, each of the bosses 72 is inserted into each of the insertion holes 84 without a gap. The inner diameter of each of the small holes 85 is substantially the same as the outer diameter of each of the pins 73. Therefore, each of the pins 73 is inserted into each of the small holes 85 without a gap. As a result, the receiving portion 81 is accurately positioned with respect to the attachment surface 71. In this state, the upper surface of each of the bosses 72 is slightly below the upper surface of the receiving portion 81. The leading end portion of each of the pins 73 protrudes above the receiving portion 81. Next, the user arranges the presser plate 90 on the receiving portion 81 that has been positioned with respect to the attachment surface 71, such that the presser plate 90 is pressed against the receiving portion 81 from above. Further, the user inserts each of the pins 73, which protrudes upward from each of the small holes 85, into each of the five small holes 92. Thus, the presser plate 90 is positioned with respect to the upper surface of the receiving portion 81. In this state, each of the six attachment holes 91 faces the screw hole 75 of each of the bosses 72. There is a slight gap between the lower surface of the presser plate 90 and the upper surface of each of the bosses 72. Next, the user inserts each of the screws 99 into each of the six attachment holes 91. Further, the user sequentially screws each of the screws 99 into the screw hole 75 of each of the bosses 72. Each of the screws 99 is a countersunk screw. A tapered portion of a head portion of each of the screws 99 comes into contact with a chamfered portion (refer to FIG. 6) of each of the attachment holes 91. As shown in FIG. 8, the presser plate 90 is pushed down by an amount corresponding to the slight gap between the presser plate 90 and each of the bosses 72. The receiving portion 81 is slightly compressed between the presser plate 90 and the attachment surface 71. Thus, the presser plate 90 and the attachment surface 71 firmly clamp and hold the receiving portion 81. The six screws 99 fix the elastic body 80 via the presser plate 90 between both the end portions in the extending direction of the elastic body 80. Thus, the elastic body 80 is firmly attached to the attachment surface 71. In addition, the five pins 73 fix the elastic body 80 between positions at which the six screws 99 fix the elastic body 80. As a result, the whole of the elastic body 80 is attached to the attachment surface 71 without displacement. The locking groove 86 is locked with the second edge rib 77. Thus, the positional displacement of the elastic body 80 is further inhibited. The elastic body 80 is firmly attached to the attachment surface 71 of the inner frame side 64. In this state, the upper surfaces of the head portions of the screws 99 are slightly below the upper surface of the presser plate 90. Although not shown in the drawings, the upper surfaces of the pins 73 are also slightly below the upper surface of the presser plate 90. As a result, the head portions of the screws 99 and the pins 73 are not caught on the sewing workpiece 3 when the outer frame 50 and the inner frame 60 clamp the sewing workpiece 3.

Operations of the embroidery frame 40 will be explained with reference to FIG. 3 and FIG. 8. The user places the outer frame 50 on the table (not shown in the drawings) such that the front surface of the outer frame 50 is directed upward. Next, the user positions and places the sewing workpiece 3 on the upper side of the outer frame 50. The user positions the inner frame 60 with respect to the outer frame 50 such that the upper surface of the inner frame 60 is directed upward. In this case, the user pushes the inner frame 60 downward from the upper side of the sewing workpiece 3, and fits the inner frame 60 into the inside of the outer frame 50 via the sewing workpiece 3. Next, the user pulls outer edge portions of the sewing workpiece 3 and causes the sewing workpiece 3 to be in a stretched state. Therefore, as shown in FIG. 3, the embroidery frame 40 clamps the sewing workpiece 3 between an inner peripheral surface of the outer frame 50 and an outer peripheral surface of the inner frame 60.

As shown in FIG. 8, the sewing workpiece 3 comes into contact with the contact surfaces 87 of the respective elastic bodies 80, at the inner frame sides 62 and 64 (FIG. 8 shows the inner frame side 64 only). The sewing workpiece 3 is in close contact with the contact surfaces 87. The friction coefficient between the sewing workpiece 3 and the contact surfaces 87 is high. Therefore, the sewing workpiece 3 is unlikely to be displaced from the embroidery frame 40. Generally, a holding force with which the sewing workpiece 3 is held is weak at a long side portion of a substantially rectangular embroidery frame, in comparison to a short side portion of the substantially rectangular embroidery frame. In the embroidery frame 40 of the present embodiment, the elastic bodies 80 are respectively attached to the inner frame sides 62 and 64, which are the long side portions of the inner frame 60. It may be thus possible to improve the holding force with which the sewing workpiece 3 is held.

Further, the inclined surface 88 of the contact surface 87 is inclined in a direction to approach the inside of the inner frame 60, from the lower surface side toward the upper surface side of the inner frame 60. In contrast to this, the inner peripheral surface of the outer frame side 54 that faces the inclined surface 88 is inclined in a direction opposite to the inclined surface 88. Therefore, the inner peripheral surface of the outer frame side 54 that faces the inclined surface 88 is likely to be in close contact with the inclined surface 88. The inner peripheral surface of the outer frame side 52 is also inclined in the same manner as the inner peripheral surface of the outer frame side 54. Thus, the inner frame 60 that is fitted into the inside of the outer frame 50 is unlikely to be displaced upward from the outer frame 50. As a result, it may be possible to inhibit the inner frame 60 from floating. Further, the inclined surface 88 may hold the sewing workpiece 3 in a state in which the sewing workpiece 3 is bent in a substantially Z shape. Thus, the holding force with which the embroidery frame 40 holds the sewing workpiece 3 may be further improved.

Types of the elastic body 80 will be explained with reference to FIG. 9 and FIG. 10. The elastic body 80 of the present embodiment can be selected from among five types of elastic bodies 80A to 80E. As shown in FIG. 9, each of the elastic bodies 80A to 80E has a different combination of a material, a hardness and a surface profile. The surface profile is a surface profile of the contact surface 87. The unit of hardness is "°" and is denoted by type A that conforms to JIS_K_6253. The combinations of the material, the hardness and the surface profile shown in FIG. 9 are merely one example, and other combinations may be used. A material, a hardness and a surface profile that are different from those shown in FIG. 9 may be used. With regard to the elastic body 80A, it is assumed that the material is a thermoplastic elastomer, the hardness is 70°, and the surface profile is "type 1", which is a rough surface profile. With regard to the elastic body 80B, it is assumed that the material is a urethane rubber, the hardness is 60°, and the surface profile is "type 2", which is a rough surface profile that is different from "type 1". With regard to the elastic body 80C, it is assumed that the material is a silicone rubber, the hardness is 60° to 80°, and the surface profile is "type 3", which is a jagged surface profile. With regard to the elastic body 80D, it is assumed that the material is a thermoplastic elastomer, the hardness is 80°, and the surface profile is "type 4", which is a pyramid-shaped surface. With regard to the elastic body 80E, it is assumed that the material is a urethane rubber, the hardness is 70°, and the surface profile is "type 2", which is the rough surface profile.

Figure 10:
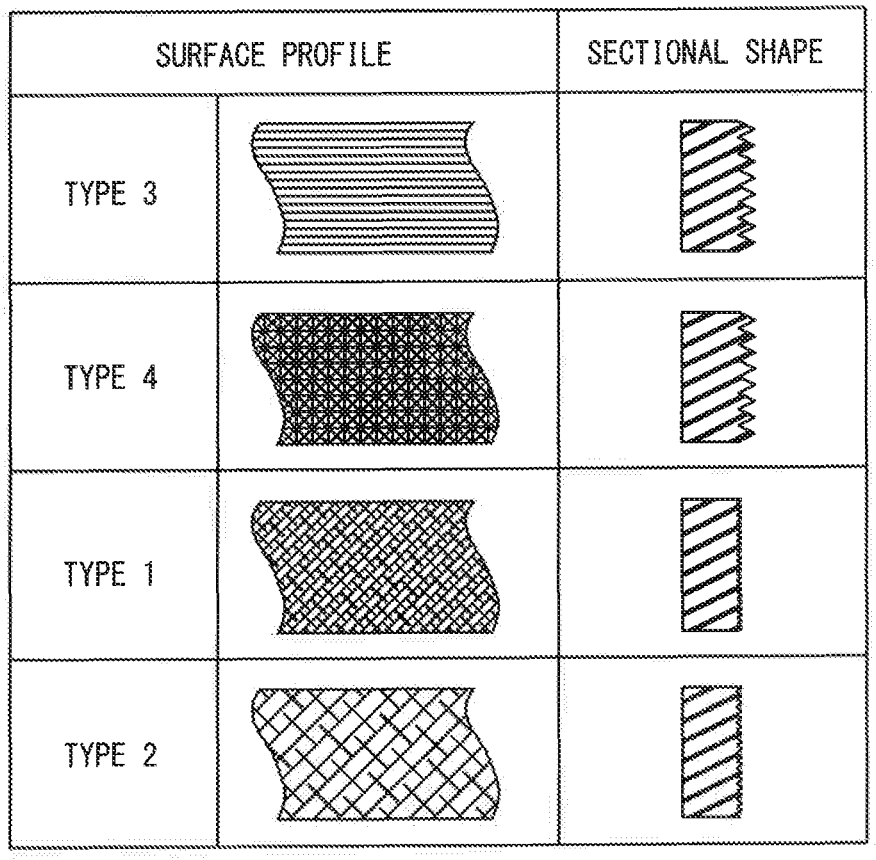
FIG. 10 is a table showing surface profiles and sectional shapes of the elastic body.

As shown in FIG. 10, "type 3" indicates a surface profile in which a plurality of grooves each having a V-shaped cross section are arranged in parallel with the extending direction of the contact surface 87. "Type 4" indicates a surface profile in which small square pyramid-shaped protrusions are arranged in the up-down direction and the left-right direction. "Type 1" and "type 2" indicate a sandpaper-like surface profile. The surface profile of "type 2" is a rougher surface profile than the surface profile of "type 1".

In the embroidery frame 40 of the present embodiment, the elastic bodies 80A to 80E can be replaced in accordance with a type of fabric, which is the sewing workpiece 3. As shown in FIG. 9, generally, there are three types of fabric, i.e., a thin fabric, a normal fabric and a thick fabric. Examples of the thin fabric include broadcloth, organdie and the like. Examples of the normal fabric include felt, cotton sailcloth and the like. Examples of the thick fabric include denim, leather and the like.

The broadcloth is particularly fine-textured among the thin fabrics. The broadcloth is suitable for the elastic body 80A, for example. Since the elastic body 80A has a surface profile with a fine surface roughness, there is a high degree of adherence between the elastic body 80A and the broadcloth. The friction coefficient between the elastic body 80A and the broadcloth is high. Therefore, the elastic body 80A may reliably hold the broadcloth without damaging it. The organdie is a plain-woven thin fabric, and is a somewhat sheer fabric. The organdie is suitable for the elastic body 80B, for example. Therefore, the elastic body 80A or 80B, whose surface roughness is fine, may reliably hold the thin fabric without damaging it.

The felt and the cotton sailcloth, which are normal fabrics, are suitable for the elastic body 80C, for example. The denim, which is a thick fabric in comparison to the other fabrics, is suitable for the elastic body 80D, for example. There is a poor degree of adherence between the denim and the elastic body having a low hardness or the elastic body in which the unevenness of the surface profile is small. Therefore, there are cases in which the denim slips with respect to the elastic body. The elastic body 80D has a relatively high hardness and has a pyramid type surface profile. Therefore, the elastic body 80D may reliably hold the denim, which is a thick fabric. The leather is suitable for the elastic body 80E, for example.

Thus, in accordance with the type of the fabric, the user selects an optimal elastic body from among the elastic bodies 80A to 80E, and attaches the selected elastic body to the inner frame 60. Thus, the embroidery frame 40 may improve the holding force in accordance with the type of the fabric. The fabric may not be displaced with respect to the embroidery frame 40 when the sewing machine 1 is performing sewing. As a result, the sewing quality of the sewing machine 1 may be improved.

As explained above, the embroidery frame 40 of the present embodiment is provided with the outer frame 50 and the inner frame 60. The outer frame 50 has a substantially rectangular ring shape. The inner frame 60 is a substantially rectangular ring-shaped frame body that is fitted into the inside of the outer frame 50. The elastic body 80 is attached to the inner frame 60 using the presser plate 90 and the screws 99. The contact portion 82 of the elastic body 80 is arranged on the outer peripheral surface of the inner frame 60. When the inner frame 60 and the outer frame 50 clamp and hold the sewing workpiece 3, the contact portion 82 comes into close contact with the sewing workpiece 3. As a result, the embroidery frame 40 may inhibit the sewing workpiece 3 from being displaced between the outer frame 50 and the inner frame 60, and it may be possible to improve the holding force with which the sewing workpiece 3 is held. As the holding force with which the sewing workpiece 3 is held may be improved, it may be possible to increase the size of the embroidery frame 40.

In the above-described embodiment, the elastic bodies 80 are respectively attached to the mutually facing inner frame sides 62 and 64 of the inner frame 60. Both the inner frame sides 62 and 64 are longer than the inner frame sides 61 and 63. The embroidery frame 40 may improve the holding force with which the sewing workpiece 3 is held at the inner frame sides 62 and 64.

The elastic body 80 is provided with the receiving portion 81 and the contact portion 82. The receiving portion 81 is a portion that is attached to the attachment surface 71 of the inner frame 60. The contact portion 82 is a flat plate-shaped portion that is arranged between the outer peripheral surface of the inner frame 60 and the inner peripheral surface of the outer frame 50. The presser plate 90 presses the receiving portion 81 against the attachment surface 71. Each of the screws 99 fixes the presser plate 90 to the attachment surface 71. Thus, the embroidery frame 40 may firmly fix the elastic body 80 to the attachment surface 71.

The elastic body 80 is configured to be easily attached to and removed from the inner frame 60. The elastic body 80 may be selected from among the elastic bodies 80A to 80E. The contact surfaces 87 of the contact portions 82 of the respective elastic bodies 80A to 80E have different surface profiles. The user can select the surface profile of the elastic body 80 that comes into contact with the sewing workpiece 3, in accordance with the type of the sewing workpiece 3 to be held by the embroidery frame 40. The user can select the surface profile such that the adherence and the friction coefficient between the sewing workpiece 3 and the elastic body 80 are increased. Thus, the embroidery frame 40 may further improve the holding force with which the sewing workpiece 3 is held, in accordance with the type of the sewing workpiece 3.

Each of the elastic bodies 80A to 80E has a different hardness. The user can select the hardness of the elastic body 80 that comes into contact with the sewing workpiece 3, in accordance with the type of the sewing workpiece 3 to be held by the embroidery frame 40. The user can select the hardness of the elastic body 80 such that the friction coefficient between the sewing workpiece 3 and the elastic body 80 is increased. Thus, the embroidery frame 40 may further improve the holding force with which the sewing workpiece 3 is held.

The present disclosure is not limited to the above-described embodiment and various modifications are possible. A first modified example and a second modified example will be explained. The first modified example will be explained with reference to FIG. 11. In the above-described embodiment, the elastic bodies 80 are attached to and removed from the attachment surfaces 71 of the inner frame 60, using the presser plates 90 and the screws 99. However, as in the first modified example, elastic bodies 180 may be detachably fitted into an inner frame 160.

Figure 11:
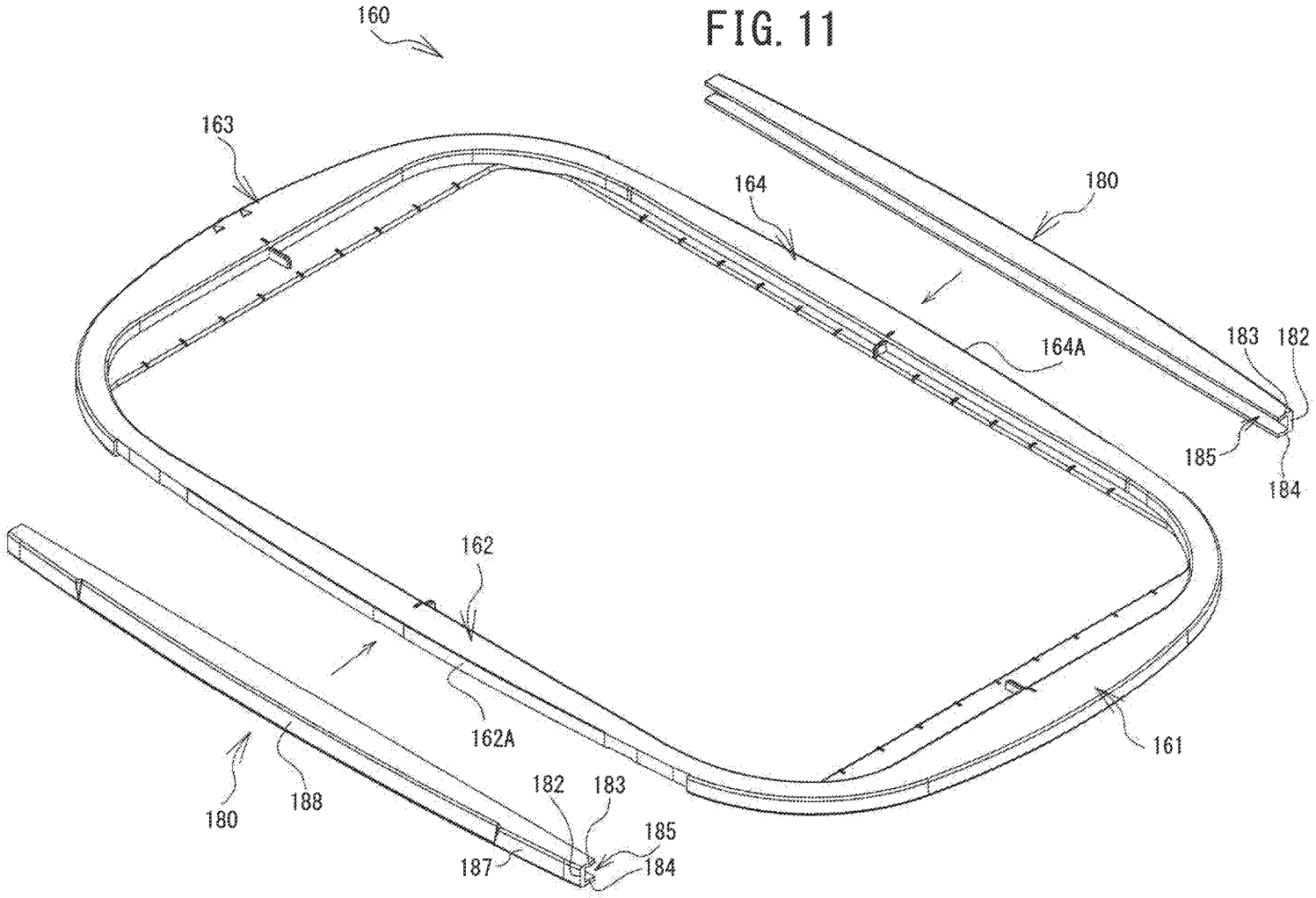
FIG. 11 is an exploded perspective view of an inner frame according to a first modified example.

As shown in FIG. 11, the inner frame 160 is a frame body having a substantially rectangular ring shape. Similarly to the inner frame 60, the inner frame 160 is provided with inner frame sides 161 to 164 and the like. The inner frame sides 161 and 163 are a pair of short side portions. The inner frame sides 162 and 164 are a pair of long side portions. The inner frame sides 162 and 164 extend substantially linearly in a direction that is substantially orthogonal to the extending direction of the inner frame sides 161 and 163. An attachment surface 162A is provided at a center potion in the extending direction of an outer peripheral surface of the inner frame side 162. The center portion in the extending direction of the outer peripheral surface of the inner frame side 162 is a part of the outer peripheral surface of the inner frame side 162 excluding both end sides in the extending direction of the outer peripheral surface. An attachment surface 164A is provided at a center portion in the extending direction of an outer peripheral surface of the inner frame side 164. The center portion in the extending direction of the outer peripheral surface of the inner frame side 164 is a part of the outer peripheral surface of the inner frame side 164 excluding both end sides in the extending direction of the outer peripheral surface. Each of the attachment surfaces 162A and 164A is a stepped surface that is one step lower toward the inside of the inner frame 160.

Each of the elastic bodies 180 is a long member. A cross section that is orthogonal to the extending direction of the elastic body 180 is substantially U-shaped. The elastic body 180 is provided with a bottom wall portion 182 and a pair of side wall portions 183 and 184. The bottom wall portion 182 and the side wall portions 183 and 184 are plate-shaped portions having an elongated rectangular shape. The side wall portions 183 and 184 are respectively provided in a standing condition on both end portions in a direction orthogonal to the extending direction of the bottom wall portion 182. A groove 185 is formed on the inside surrounded by the bottom wall portion 182 and the side wall portions 183 and 184. An outer surface of the bottom wall portion 182 is a contact surface 187 that comes into contact with the sewing workpiece 3 (refer to FIG. 3). In a state in which the elastic body 180 is attached to the attachment surface 162A, an inclined surface 188 is inclined in a direction to approach the inside of the inner frame 160, from the lower surface side toward the upper surface side (in a direction from the lower side toward the upper side in FIG. 11) of the inner frame 160. A width (a distance between the side wall portions 183 and 184) of the groove 185 is slightly shorter than a height in the up-down direction of each of the inner frame sides 162 and 164. Therefore, the inner frame sides 162 and 164 can be tightly fitted into the grooves 185 of the elastic bodies 180.

The elastic bodies 180 of the first modified example may be easily attached to and removed from the inner frame sides 162 and 164 by using elastic deformation of the elastic bodies 180. In a similar manner to the above-described embodiment, the elastic body 180 can be selected from among a plurality of types of elastic bodies that have different combinations of the material, the hardness and the surface profile. Elastic bodies having the same shape as the elastic bodies 180 may be fitted into an outer frame. In this case, it is preferable to fit the elastic bodies into a pair of long side portions of the outer frame.

Figure 12:
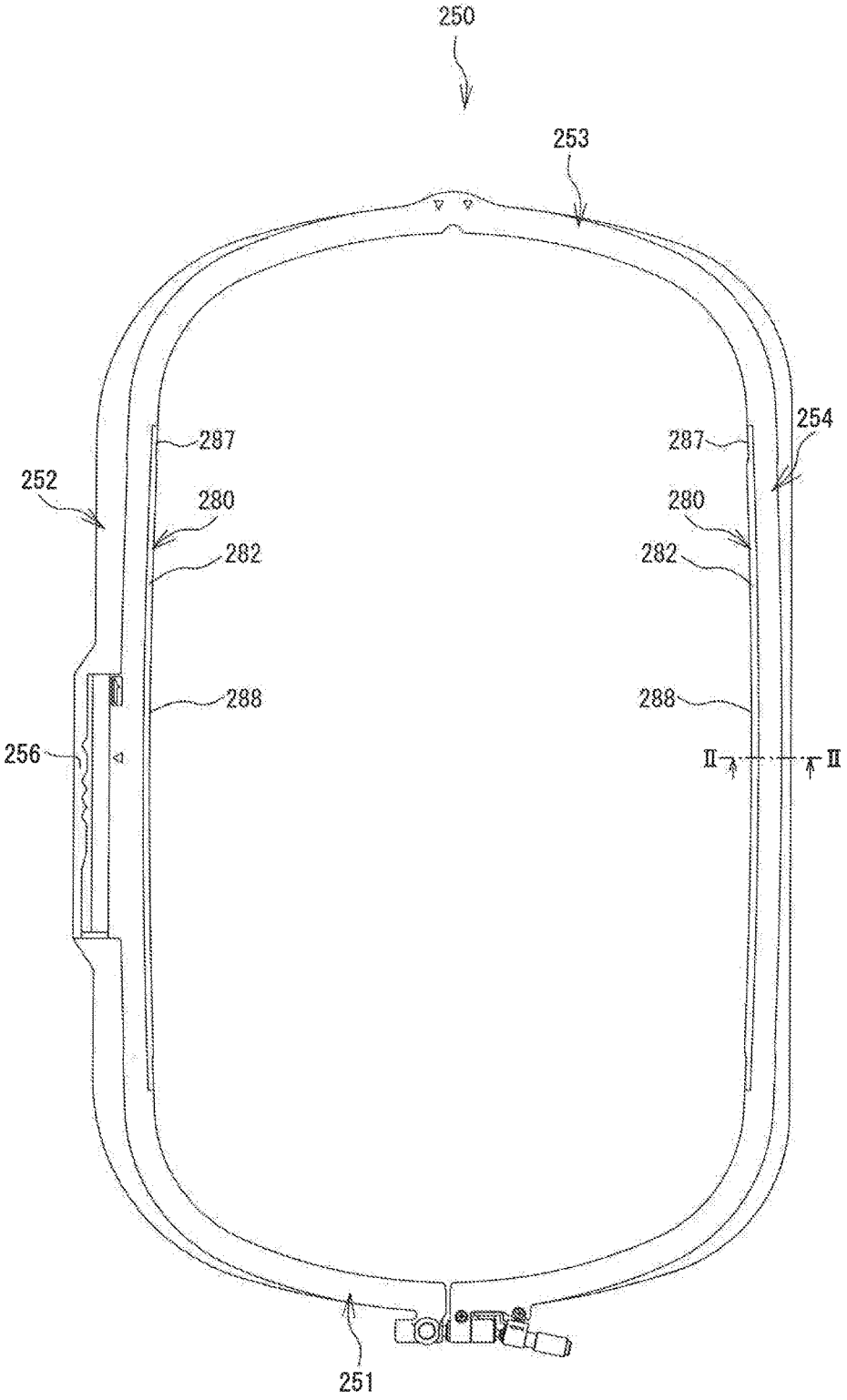
FIG. 12 is a plan view of an outer frame according to a second modified example.

A second modified example will be explained with reference to FIG. 12 and FIG. 13. In the above-described embodiment, the elastic bodies 80 are attached to and removed from the inner frame 60. However, as in the second modified example, elastic bodies 280 may be attached to and removed from an outer frame 250. As shown in FIG. 12, the outer frame 250 is a frame body having a substantially rectangular ring shape. Similarly to the outer frame 50 (refer to FIG. 2), the outer frame 250 is provided with outer frame sides 251 to 254 and the like. The outer frame sides 251 and 253 are a pair of short side portions. The outer frame sides 252 and 254 are a pair of long side portions. The outer frame sides 252 and 254 extend substantially linearly in a direction that is substantially orthogonal to the extending direction of the outer frame sides 251 and 253. A frame attachment portion 256, which is the same as the frame attachment portion 56 (refer to FIG. 2), is provided at a center portion in the extending direction of an outer side surface of the outer frame side 252.

Figure 13:
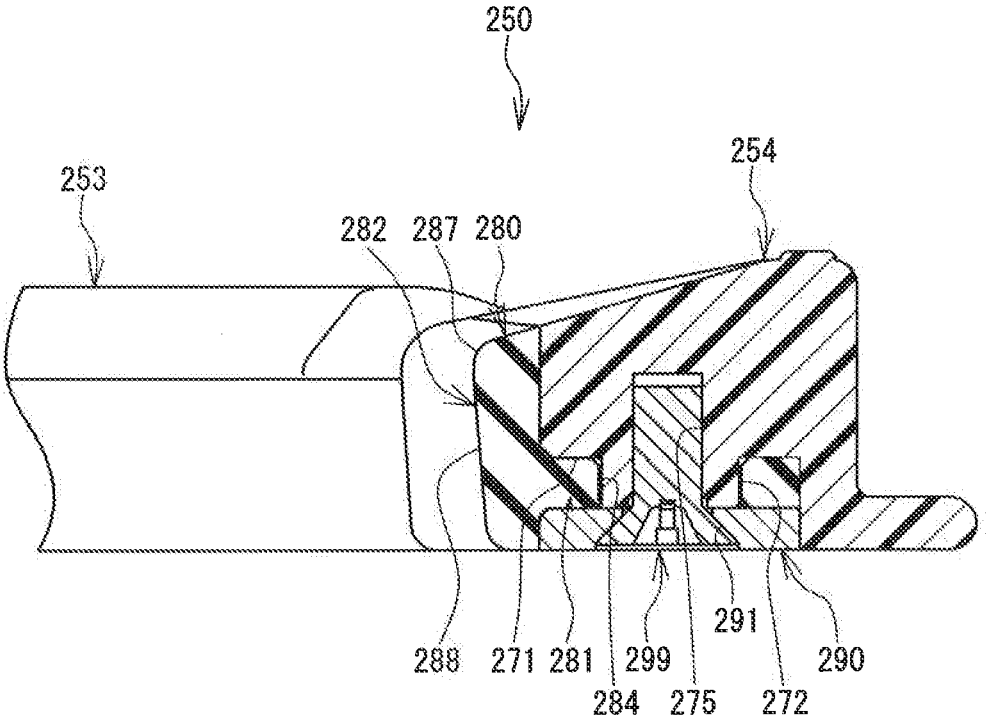
FIG. 13 is a cross-sectional view taken in the direction of arrows along a line II-II shown in FIG. 12.

As shown in FIG. 13, an attachment surface 271 is provided at a center portion in the extending direction of a lower surface of the outer frame side 254. The center portion in the extending direction of the lower surface of the outer frame side 254 is a part of the lower surface of the outer frame side 254 excluding both end portions in the extending direction of the lower surface. An attachment surface (not shown in the drawings) that is the same as the attachment surface 271 is provided at a center portion in the extending direction of a lower surface of the outer frame side 252. The attachment surface 271 is a portion to which the elastic body 280 and a presser plate 290 are attached. The attachment surface 271 is strip shaped in a bottom view. The width of the attachment surface 271 gradually increases from both end sides in the extending direction of the attachment surface 271 toward the center.

In a similar manner to the above-described embodiment, six bosses 272 (only one of them is shown in FIG. 13) and five pins (not shown in the drawings) are alternately provided along the extending direction of the attachment surface 271. Two of the six bosses 272 are provided on both end sides in the extending direction of the attachment surface 271. Each of the bosses 272 vertically protrudes from the attachment surface 271. Each of the bosses 272 has a screw hole 275 on the inside thereof. Each of the pins vertically protrudes from the attachment surface 271.

The elastic body 280 has a similar shape to the elastic body 80 (refer to FIG. 5 and FIG. 6), and is provided with a receiving portion 281 and a contact portion 282. The receiving portion 281 is provided with a plurality of insertion holes 284, a plurality of small holes (not shown in the drawings), a locking groove (not shown in the drawings), a plurality of rectangular ribs (not shown in the drawings) and the like. The contact portion 282 is provided with a contact surface 287 and an inclined surface 288. The presser plate 290 has a similar shape to the presser plate 90 (refer to FIG. 5 and FIG. 6), and is provided with a plurality of attachment holes 291, a plurality of small holes (not shown in the drawings) and the like.

A method for attaching the elastic bodies 280 to the outer frame 250 will be explained with reference to FIG. 13. As an example, a method for attaching the elastic body 280 to the attachment surface 271 of the outer frame side 254 will be explained. The user places the outer frame 250 on a table (not shown in the drawings) in a state in which the bottom surface side is directed upward (a state in which the up and down in FIG. 13 is reversed). Then, in a state in which the contact portion 282 faces toward the inside of the outer frame side 254, the user arranges the receiving portion 281 on the attachment surface 271. The user inserts the bosses 272 into the plurality of insertion holes 284, respectively. The user inserts the pins (not shown in the drawings) of the attachment surface 271 into the plurality of small holes (not shown in the drawings) of the elastic body 280, respectively. Then, the user arranges, from above, the presser plate 290 on the receiving portion 281 that has been positioned with respect to the attachment surface 271. Further, the user inserts the pins of the attachment surface 271 into the plurality of small holes of the elastic body 280, respectively. Thus, the presser plate 290 is positioned with respect to an upper surface of the receiving portion 281. In this state, the plurality of attachment holes 291 are respectively arranged on the screw holes 275 of the six bosses 272.

Next, the user inserts screws 299 into the plurality of attachment holes 291, respectively. Further, the user sequentially screws each of the screws 299 into the screw hole 275 of each of the bosses 272. The presser plate 290 is pushed down onto the attachment surface 271 side via the receiving portion 281. The receiving portion 281 is slightly compressed between the presser plate 290 and the attachment surface 271. The presser plate 290 and the attachment surface 271 firmly clamp and hold the receiving portion 281. Thus, the elastic body 280 is firmly attached to the attachment surface 271. Therefore, the user can attach the elastic body 280 to the attachment surface 271 of each of the outer frame sides 252 and 254 of the outer frame 250. As shown in FIG. 12, the contact surface 287 of each of the elastic bodies 280 can be arranged on an inner peripheral surface of each of the outer frame sides 252 and 254. The second modified example exerts similar operational effects to those of the above-described embodiment, by fitting the substantially rectangular ring-shaped inner frame (having no elastic body) into the outer frame 250.

The embroidery frame of the present disclosure is not limited to the above-described embodiment, the first modified example and the second modified example, and can be modified in various ways. The following modified examples can be applied to all of the above-described embodiment, the first modified example and the second modified example. For example, the structure of the sewing machine 1 to which the embroidery frame 40 is attached may be changed as appropriate. The sewing machine 1 may be, for example, an industrial sewing machine or a multi-needle sewing machine.

The shape of the embroidery frame is not limited to a substantially rectangular ring shape. For example, the embroidery frame may have another shape, such as a circular shape, an elliptical shape, a square shape or the like. The four corner portions 57 of the outer frame 50 and the four corner portions 65 of the inner frame 60 need not necessarily have a curved shape that is curved in an arc shape, and may have a shape that is bent at a substantially right angle.

The elastic body 80 need not necessarily be attached to each of the inner frame sides 62 and 64 that are the long side portions of the inner frame 60, and may be attached to at least one of the inner frame sides 61 to 64. For example, the elastic body 80 may be attached to each of the inner frame sides 61 and 63 that are the short side portions. The elastic body 80 may be attached to each of all the inner frame sides 61 to 64.

The attachment surface 71 of the inner frame 60 need not necessarily be provided with the six bosses 72 and the five pins 73. For example, the plurality of pins 73 may be omitted. The number of the bosses 72 and the number of the pins 73 are not limited to the numbers exemplified in the above-described embodiment.

The elastic body 80 is not limited to a long member that extends substantially linearly, and may have a circular ring shape or may be arranged on the entire inner peripheral surface of the inner frame. The rectangular ribs 83 of the elastic body 80 may be omitted. The inclined surface 88 of the elastic body 80 may be omitted. In this case, the contact surface 87 is a surface that is parallel to the up-down direction. Therefore, the contact surface of the outer frame 50 that faces the contact surface 87 may be a surface that is parallel to the up-down direction.

A member that attaches the elastic body 80 to the inner frame 60 is not limited to the presser plate 90 and the screws 99, and another member may be used. For example, the elastic body 80 may be directly fixed by the screws 99 without using the presser plate 90. The structure of the fastening mechanism 46 that is provided on the outer frame 50 is not limited to the above-described embodiment. The fastening mechanism 46 may be omitted.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame comprising:

an inner frame that is formed in a ring shape;

an outer frame that is formed in a ring shape and that is configured to be fitted onto an outside of the inner frame, an inner peripheral surface of the outer frame being provided opposite to an outer peripheral surface of the inner frame in a state in which the outer frame is fitted onto the outside of the inner frame;

an elastic member that is arranged on at least one of the outer peripheral surface of the inner frame and the inner peripheral surface of the outer frame, the elastic member being arranged between the outer peripheral surface of the inner frame and the inner peripheral surface of the outer frame in a state in which the outer frame is fitted onto the outside of the inner frame; and an attachment member that detachably attaches the elastic member to one of the inner frame and the outer frame, wherein the elastic member includes:

a plate-shaped portion that has a flat plate shape extending in a first direction and that is arranged between the outer peripheral surface of the inner frame and the inner peripheral surface of the outer frame in a state in which the outer frame is fitted onto the outside of the inner frame, the first direction being a direction orthogonal to a second direction, the second direction being a direction that the outer peripheral surface and the inner peripheral surface face each other; and a receiving portion that is connected to the plate-shaped portion and that is attached to one of the inner frame and the outer frame, the receiving portion extending from the plate-shaped portion in the second direction in a state in which the outer frame is fitted onto the outside of the inner frame, and the attachment member includes:

a plate member that pushes the receiving portion against one of the inner frame and the outer frame in the first direction; and a fixing tool that is configured to fix the plate member to one of the inner frame and the outer frame.

2. The embroidery frame according to claim 1, wherein each of the outer frame and the inner frame that has a substantially rectangular ring shape includes:

a first side portion;

a second side portion that is longer than the first side portion, the second side portion extending in a direction that is substantially orthogonal to an extending direction of the first side portion; and a connecting portion that connects the first side portion and the second side portion in one of a bent manner and a curved manner, and wherein the elastic member is arranged on at least one of the second side portion of the outer frame and the second side portion of the inner frame.

3. The embroidery frame according to claim 2, wherein a front surface of the plate-shaped portion is an uneven shape in the second direction.

4. The embroidery frame according to claim 3, wherein the attachment member is made of rubber or elastomer.

5. The embroidery frame according to claim 2, wherein the attachment member is made of rubber or elastomer.

6. The embroidery frame according to claim 1, wherein a front surface of the plate-shaped portion is an uneven shape in the second direction.

7. The embroidery frame according to claim 6, wherein the attachment member is made of rubber or elastomer.

8. The embroidery frame according to claim 1, wherein the attachment member is made of rubber or elastomer.

9. An embroidery frame comprising:

an inner frame that is formed in a ring shape;

an outer frame that is formed in a ring shape and that is configured to be fitted onto an outside of the inner frame, an inner peripheral surface of the outer frame being provided opposite to an outer peripheral surface of the inner frame in a state in which the outer frame is fitted onto the outside of the inner frame;

an elastic member that is arranged on at least one of the outer peripheral surface of the inner frame and the inner peripheral surface of the outer frame, the elastic member being arranged between the outer peripheral surface of the inner frame and the inner peripheral surface of the outer frame in a state in which the outer frame is fitted onto the outside of the inner frame; and an attachment member that detachably attaches the elastic member to one of the inner frame and the outer frame, wherein the elastic member includes a plate-shaped portion having a flat plate shape, the plate-shaped portion extending in a first direction and being arranged between the outer peripheral surface of the inner frame and the inner peripheral surface of the outer frame in a state in which the outer frame is fitted onto the outside of the inner frame, the first direction being a direction orthogonal to a second direction and a third direction, the second direction being a direction that the outer peripheral surface and the inner peripheral surface face each other, the third direction being a direction that the inner frame or the outer frame extends in an annular direction at a position at which the outer peripheral surface and the inner peripheral surface face each other in the second direction, the attachment member includes a pair of side wall portions that extends in the second direction from both end portions of the plate-shaped portion in the first direction, and one of the inner frame and the outer frame is fitted onto a groove that is formed by the plate-shaped portion and the pair of side wall portions, in a state in which the plate-shaped portion is arranged between the outer peripheral surface of the inner frame and the inner peripheral surface of the outer frame, when the outer frame is fitted onto the outside of the inner frame.

10. The embroidery frame according to claim 9, wherein a front surface of the plate-shaped portion is an uneven shape in the second direction.

11. The embroidery frame according to claim 10, wherein the attachment member is made of rubber or elastomer.

12. The embroidery frame according to claim 9, wherein the attachment member is made of rubber or elastomer.

13. The embroidery frame according to claim 9, wherein each of the outer frame and the inner frame that has a substantially rectangular ring shape includes:

a first side portion;

a second side portion that is longer than the first side portion, the second side portion extending in a direction that is substantially orthogonal to an extending direction of the first side portion; and a connecting portion that connects the first side portion and the second side portion in one of a bent manner and a curved manner, and wherein the elastic member is arranged on at least one of the second side portion of the outer frame and the second side portion of the inner frame.

14. The embroidery frame according to claim 13, wherein a front surface of the plate-shaped portion is an uneven shape in the second direction.

15. The embroidery frame according to claim 14, wherein the attachment member is made of rubber or elastomer.

16. The embroidery frame according to claim 13, wherein the attachment member is made of rubber or elastomer.

* * * * *